US007796088B1

(12) United States Patent
Chen et al.

(10) Patent No.: US 7,796,088 B1
(45) Date of Patent: Sep. 14, 2010

(54) STRETCHABLE ANTENNA ASSEMBLY AND NOTEBOOK COMPUTER WITH THE ANTENNA ASSEMBLY THEREOF

(75) Inventors: Hen-An Chen, Taipei Hsien (TW); San-Yi Kuo, Taipei Hsien (TW); Bing-Chun Chung, Taipei Hsien (TW)

(73) Assignee: Wistron Neweb Corporation, Hsichih, Taipei Hsien (TW)

( * ) Notice: Subject to any disclaimer, the term of this patent is extended or adjusted under 35 U.S.C. 154(b) by 0 days.

(21) Appl. No.: 12/007,146

(22) Filed: Jan. 7, 2008

(30) Foreign Application Priority Data

Aug. 20, 2007 (TW) ..... 96130746 A

(51) Int. Cl.
*H01Q 1/24* (2006.01)

(52) U.S. Cl. ..... 343/702

(58) Field of Classification Search ..... 343/702, 343/872, 878, 880, 883; 455/575.1, 575.3, 455/575.4

See application file for complete search history.

(56) References Cited

U.S. PATENT DOCUMENTS 5,943,018 A * 8/1999 Miller ..... 343/702
6,259,409 B1 * 7/2001 Fulton et al. ..... 343/702

FOREIGN PATENT DOCUMENTS

DE 102006015790 A1 7/2007

* cited by examiner

*Primary Examiner*—Hoang V Nguyen

(57) ABSTRACT

A stretchable antenna assembly and a notebook computer with the antenna assembly thereof, comprising an antenna module and a holder which respectively has a guiding unit corresponding to the antenna module and the holder, and further the antenna module couples to a signal transmission element for activating with a first conductive element disposed at one side of the holder, resulting in preventing the antenna signal transmission from being interrupted whenever the antenna module is open or closed, and in further ensuring the precise locating function, and strengthening the receipt of signal.

25 Claims, 5 Drawing Sheets

STRETCHABLE ANTENNA ASSEMBLY AND NOTEBOOK COMPUTER WITH THE ANTENNA ASSEMBLY THEREOF

BACKGROUND OF THE INVENTION

1. Field of the Invention

The present invention relates to an antenna embedded in a notebook computer, more particularly to a stretchable antenna assembly.

2. Description of Related Art

Currently, some advanced notebook computers with an antenna are developing for receiving digital television signal, satellite signal and so on, so that users are able to enjoy a variety of multi-functional programs when using the computers.

TW Patent M312787 discloses an antenna device that is connected to a slot inside a computer. The slot includes a first electrical connection portion. The antenna device includes a holder having a second electrical connection portion at one side of the holder which electrically couples to the first electrical connection portion, also a radiation member coupling with the holder is able to move with the holder, and the radiation member transmits a received signal to the computer via the second electrical connection portion.

For a typical stretchable antenna, it has electrical connection portions respectively disposed at two ends of the antenna, and the antenna contacts with the electrical connection portions when the antenna is sliding in or out; sequentially, the antenna transmits a received signal to an electronic product. Due to the fact that the antenna does not attached with the electric connection portion when the antenna is in reciprocating, the antenna can not transmit the received signal to the electronic product which results that the electronic product can not constantly receive the signal.

SUMMARY OF THE INVENTION

A primary object of the present invention is to prevent the antenna signal transmission from being interrupted whenever the antenna module is open or closed.

Another object of the present invention is to enable the antenna module can be precisely located, and can stably receive signal whenever the antenna module is open or closed.

The present invention relating to a stretchable antenna assembly comprises a holder having a first guiding unit, a first conductive element coupling with the holder and paralleling to the first guiding unit, an antenna module having a second guiding unit corresponding to the first guiding unit, and coupling to a signal transmission element at the one side of the antenna module, wherein the first guiding element removably couples to the second guiding unit; and the signal transmission element activates the first conductive element for signal transmission, whereby the antenna module is reciprocating on the holder.

Also, the present invention relating to a notebook computer with a stretchable antenna assembly comprises a housing coupling a stretchable antenna assembly which includes a holder having a first guiding unit, a first conductive element coupling with the holder and paralleling to the first guiding unit, and an antenna module having a second guiding unit corresponding to the first guiding element, and coupling to a signal transmission element at one side of the antenna module, wherein the first guiding unit removably couples to the second guiding unit, and the signal transmission element activates the first conductive element for transmitting signal to the notebook computer, whereby the antenna module is reciprocating on the holder.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention can be more fully understood by reference to the following description and accompanying drawings, in which.

DETAILED DESCRIPTION OF THE INVENTION

Figure 1:
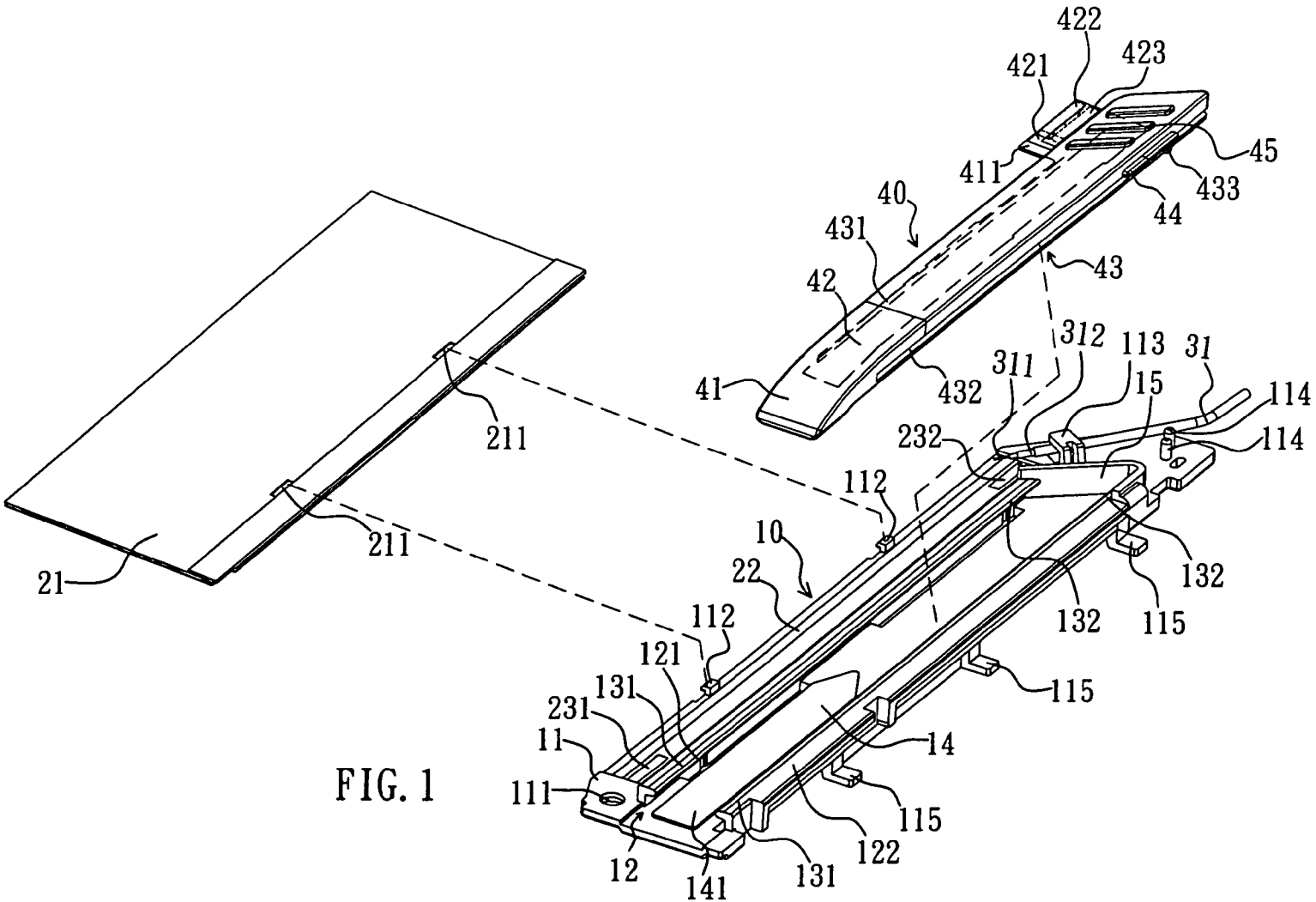
FIG. 1 is an exploration of a stretchable antenna assembly according to the present invention.
Figure 2:
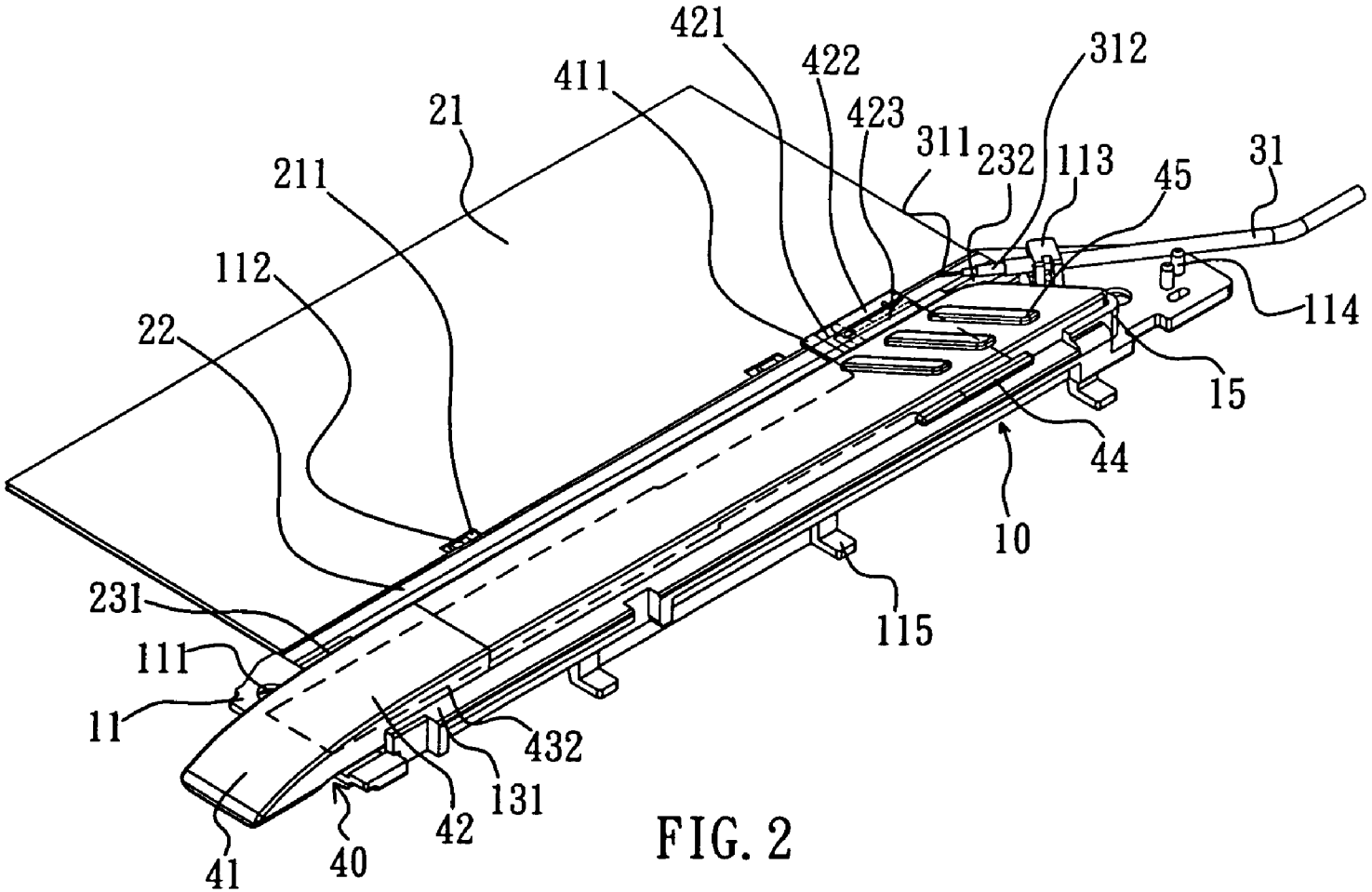
FIG. 2 is the demonstration of the antenna module in closing off according to the present invention.
Figure 3:
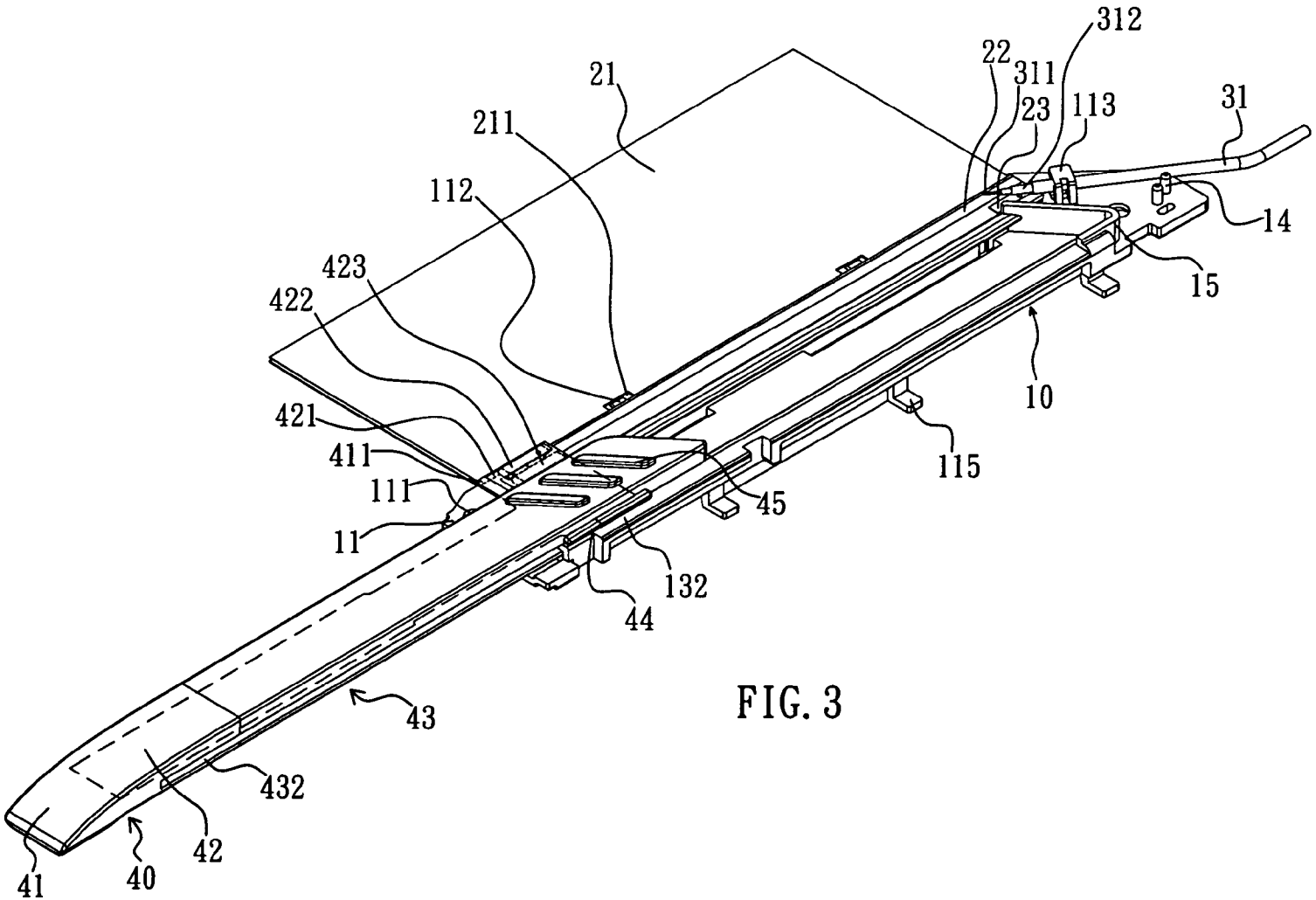
FIG. 3 is the demonstration of the antenna module in opening up according to the present invention.

Referring to the FIGS. 1, 2 and 3. The present invention relates to a stretchable antenna assembly which comprises a holder 10, a metallic grounding member 21, a first conductive member 22, two second conductive elements 231, 232, and a cable 31 as well as an antenna 40.

The holder 10 has a baseplate 11, a first guiding unit 12, a guiding groove 14 and a baffleplate 15. The first guiding unit 12 has two guiding strips 121, 122. The front end and the rear end of the first guiding unit 12 respectively has a first locating portion 131 and a second locating portion 132 such that the front end and the rear end of two guiding strips 121, 122 respectively has a wide portion for designing a plurality of locating portions. The guiding strips 121 is in parallel to the guiding strip 122 and the two guiding strips 121, 122 respectively form in inverted L-shape opposite to each other; further, the guiding groove 14 is formed by the linkage of two guiding strips 121, 122. The front end of the baseplate 11 is an open portion 141 of the guiding groove 14, and a screwing aperture 111 of the holder 10 is at the side end the open portion 141. The first side end of the baseplate 11 has a plurality of first fastening elements 112. The rear end of the baseplate 11 has a second fastening element 113 and a plurality of projections protruded from the holder 10. The second side end of the baseplate 11 has a plurality of bumps 115. The baffleplate 15 is situate at the rear end of the guiding unit 12. The first fastening element 112 and the second fastening element 113 are used to cord wires.

The one side end of the metallic grounding element 21 is coupled to the down edge of the first side end of the baseplate 11. The metallic grounding element 21 has a through-hole 211 corresponding to the first fastening element 112 for extending wires through the through-hole 211.

The first conductive element 22, such as a copper foil, connects to the top edge of the first side end of the baseplate 11 and it is disposed in parallel to the first guiding unit 12. Each of second conductive elements 231 and 232, such as coppers foils, respectively connects to the front end and the rear end of the top edge of the first side end of the baseplate 11. Further, each of second conductive elements 231, 232 electrically connects to the metallic grounding element 21 respectively. The first conductive element 22 and the second conductive element 232 disposed at the rear end of the baseplate 11 electrically connects to a signal transmission element 311 of a cable 31 and a grounding member 312 respectively.

The antenna module 40 comprises a body member 41 and a radiating member 42 coupling to the body member 41. The body member 41 forms in a slice-shape and is made of bendable soft-plastic material. The radiating member 42 is installed inside the body member 41. The rear end of the body member 41 and the radiating member 42 respectively has a protruded portion 411, 421. The protruded portion 421 of the radiating member 42 electrically couples to a signal transmission element 422 with resilient function such as a metallic resilient element, and couples to a grounding connection element 423 with resilient function such as a metallic resilient element. The down edge of the signal transmission element 422 and the grounding connection element 423 respectively extends to the downside of the protruded portion 411 of the body member 41 for elastically attaching the first conductive element 22 and the two conductive elements 231, 232 respectively.

The body member 41 has a second guiding unit 43 corresponding to the first guiding unit 12. For example, the second guiding unit 43 includes two guiding slots 431, 432 which is respectively disposed at two sides of the body member 41. The rear end of the second guiding unit 43 has a third locating portion 433 corresponding to the first and second locating portions 131, 132. For example, the rear end of the guiding slots 431, 432 respectively has a narrow portion. The rear end of the body member 41 has a stopper 44. The top edge of the rear end of the body member 41 has a plurality of protruded ribs 45. The second guiding unit 43 is extended to the rear end of the body member 41.

The second guiding unit 43 of the body member 41 removably connects to the first guiding unit 12 such that the guiding slots 431, 432 respectively engages with the guiding strips 121, 122 which results in the fact that the antenna module 40 can be removably coupled to the holder 10. When a user depresses the protruded ribs 45 and pushes the antenna module 90 toward the rear end of the holder 40 that makes the third locating portion 433 attaches to the second locating portion 132 and dispose the antenna module 40 at the rear end of the first guiding unit 12 attaching to the baffleplate 15 which enables the antenna module 40 at close status as shown in FIG. 2.

Also, when a user pushes the antenna module 40 toward the front end of the holder 10 which makes the third locating portion 433 to attach the first locating portion 131 of the front end of the first guiding unit 12, it results in the fact that the antenna module 40 is located and open by extending to the front end of the holder 10 as shown in FIG. 3. Thus, the grounding connection element 423 activates with the second conductive elements 231, 232 which respectively disposed at the front end and the rear end of the holder 10 whenever the antenna module 40 is open or close in accordance with the present invention.

In addition, the signal transmission element 422 also activates with the first conductive element 22 whenever the antenna module 40 is open, close, or moving in accordance with the present invention. Therefore, the antenna module 40 can constantly transmit the received signal to a notebook computer through a cable 31, and also user can adjust the lengths of antenna module 40 extending from the holder 10 according to the received signal.

Figure 4:
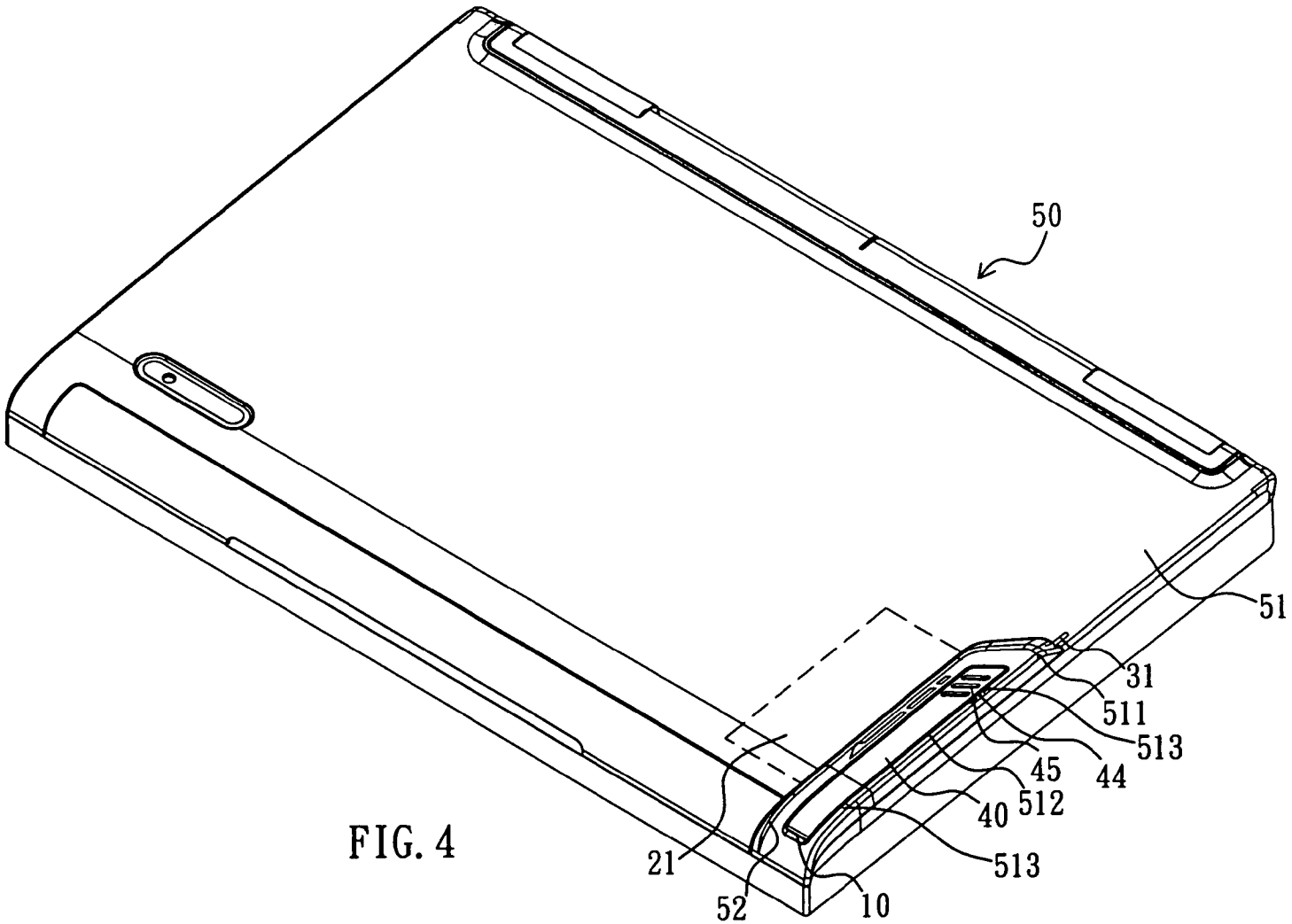
FIG. 4 is the exterior demonstration of the notebook computer with a stretchable antenna assembly according to the present invention.
Figure 5:
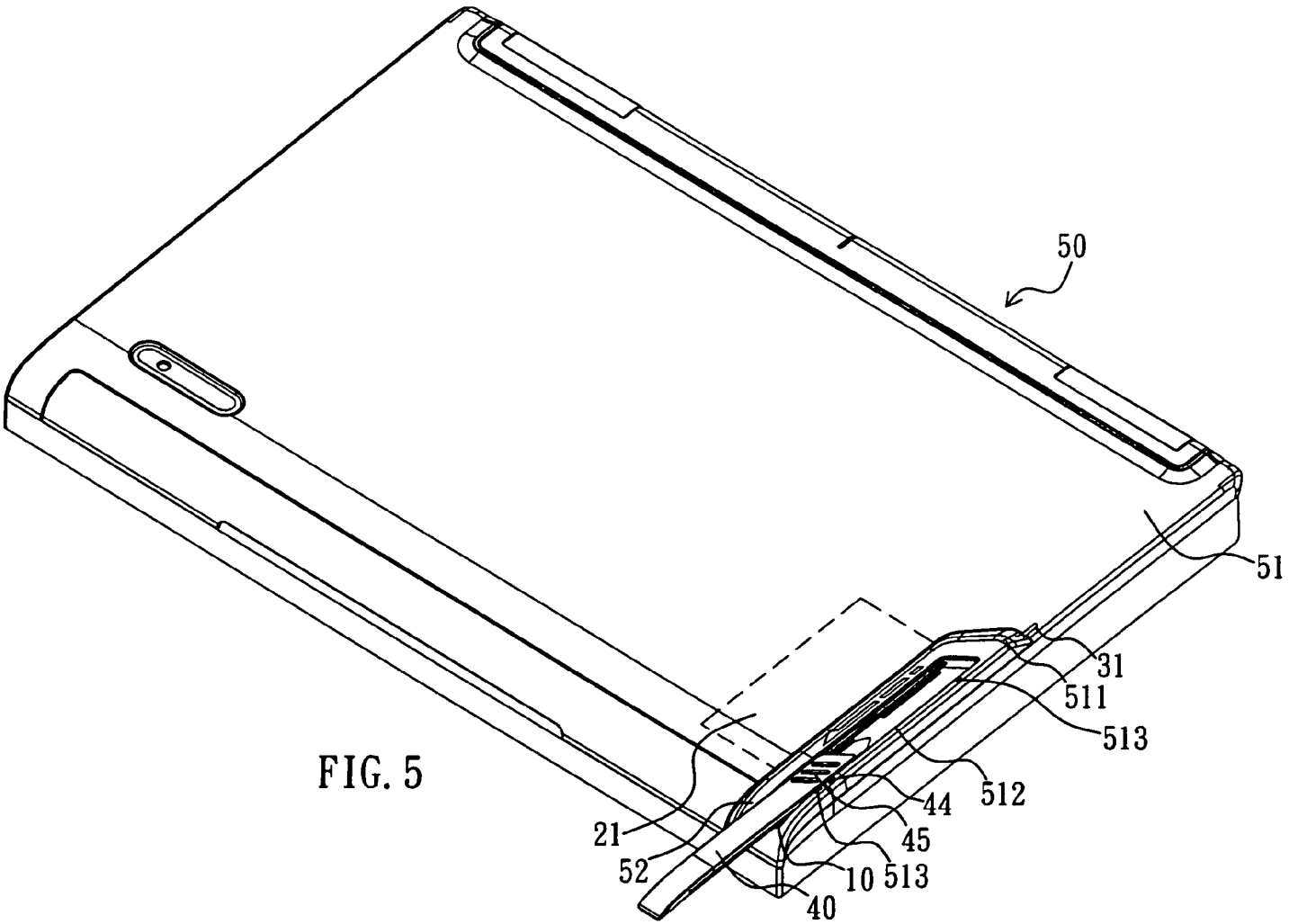
FIG. 5 is the exterior demonstration of an antenna module coupling with a notebook computer in opening up according to the present invention.

Referring to FIGS. 1, 4 and 5, which is the exterior demonstration of a notebook computer with a stretchable antenna assembly in accordance with the present invention. The antenna assembly is disposed at the housing 51 of the notebook computer 50. For example, the computer has a protruded portion 511 disposed at one side of the housing and forming in an engaging groove 52 for the holder 10. The protruded protrusion 511 has a corresponded aperture 512 to the antenna module 40 for extending the antenna module 40. A screwing aperture is disposed at the interior of the housing 51, which is corresponded to the holder 10, and the projection 114 and the bump 115 for fastening each other. Then, engaging the holder 10 with the housing 51 by employing the screw through the screwing aperture 111, and then enabling the cable 31 can electrically connect the notebook computer 50; further, transmitting the received signal from the antenna module 40 to the notebook computer 50 whenever the antenna module is open as shown in FIG. 4, or is closed as shown in FIG. 5, or even in moving. Also, the housing 51 has a baffling block 513 corresponding to a stopper 44 of the antenna module 40 for limiting the antenna module 40 reciprocating between the front end and the rear end of the engaging groove 52 inside the housing 51, and further for preventing the antenna module 40 being detached from the holder 10.

The present invention relates to a stretchable antenna assembly and a notebook computer with the antenna assembly thereof in which the antenna module is interactive with the holder, and the antenna module couples to a signal transmission element for activating with a first conductive element disposed at one side of the holder which results in preventing the antenna signal transmission from being interrupted whenever the antenna module is open or close, and further ensuring the precise locating function, and strengthening the receipt of signal. Further, the antenna module according to the present invention is bendable for preventing the damage causing by the interference with other elements when the antenna module is open.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A stretchable antenna assembly, comprising:

a holder having a first guiding unit;

a first conductive element coupling with the holder, and paralleling to the first guiding unit; and an antenna module having a second guiding unit corresponding to the first guiding unit, and coupling to a signal transmission element at one side of the antenna module;

wherein the first guiding unit removably couples to the second guiding unit; the signal transmission element activates the first conductive element for signal transmission, whereby the antenna module is reciprocating on the holder.

2. The stretchable antenna assembly of claim 1, wherein the first guiding unit includes two guiding strips; the second guiding unit includes two guiding slots respectively corresponding to the two guiding strips; the guiding slots are disposed at the two sides of the second guiding unit respectively; the two guiding strips respectively forms in an inverted L-shape opposite to each other.

3. The stretchable antenna assembly of claim 2, wherein the guiding unit has at least one locating portion; the second guiding unit has a third locating portion, disposed at the rear end of the second guiding unit, corresponding to the locating portion; when the locating portion, disposed at the first guiding unit, attaches to the third locating portion, the antenna module is fastened to the holder.

4. The stretchable antenna assembly of claim 3, wherein the locating portion, disposed at the first guiding unit, is the wide portion of the guiding strips; the third locating portion is the narrow portion of the guiding slots.

5. The stretchable antenna assembly of claim 4, wherein the first guiding unit respectively has a first locating portion disposed at the front end of the first guiding unit, and a second locating portion disposed at the rear end of the first guiding unit; the second guiding unit has the third locating portion disposed at the rear end of the second guiding unit.

6. The stretchable antenna assembly of claim 5, wherein the holder further includes a baseplate and a baffleplate;

the first side of the baseplate is coupled to the first conductive element, and the baffleplate is disposed at the rear end of the first guiding unit.

7. The stretchable antenna assembly of claim 6, wherein the front end of the baseplate has a screwing aperture; the first side of the baseplate has a plurality of the first fastening elements; the rear end of the baseplate has a second fastening element and a plurality of projections protruding from the holder; the second side of the baseplate has a plurality of bumps; the first fastening element and the second fastening element are used to cord wires; the screwing aperture, the projections and the bumps are used to fasten the holder exterior to the housing of the notebook computer.

8. The stretchable antenna assembly of claim 1, wherein the antenna module comprising:

a body member, forming in a slice-shape, made of soft-plastic material; and a radiating member installed interior to the body member;

wherein the body member and the rear end of the radiating member respectively has a protruded portion; the protruded portion of the radiating member electrically couples to the signal transmission element extending to the downside of the protruded portion of the body member.

9. The stretchable antenna assembly of claim 8, wherein the antenna module couples to a grounding connection element at the one side of the antenna module; the frond end and rear end of the holder respectively couples to a second conductive element corresponding to the grounding connection element; the protruded portion of the radiating member electrically couples to the grounding connection element extending to the downside of the protruded portion of the body member; wherein the grounding connection element is constantly coupled to the second conductive element whenever the antenna module is open or closed.

10. The stretchable antenna assembly of claim 9, wherein the holder couples to a metallic grounding member which electrically connects to the second conductive element.

11. The stretchable antenna assembly of claim 10, wherein the signal transmission element and the grounding connection are resilient substrate.

12. The stretchable antenna assembly of claim 11, wherein the first conductive element and the second conductive element respectively electrically connects to a signal transmission element of a cable and a grounding member, and the cable is used to electrically connect the notebook computer.

13. A notebook computer with a stretchable antenna assembly, comprising:

a housing coupling a stretchable antenna assembly, and the stretchable antenna assembly including:

a holder having a first guiding unit;

a first conductive element coupling with the holder, and paralleling to the first guiding unit; and an antenna module having a second guiding unit corresponding to the first guiding unit, and coupling to a signal transmission element at one side of the antenna module;

wherein the first guiding unit removably couples to the second guiding unit; and the signal transmission element activates the first conductive element for transmitting signal to the notebook computer, whereby the antenna module is reciprocating on the holder.

14. The notebook computer of claim 13, wherein the first guiding unit includes two guiding strips; the second guiding unit includes two guiding slots respectively corresponding to the two guiding strips; the guiding slots are disposed at the two sides of the second guiding unit respectively; the two guiding strips respectively forms in an inverted L-shape opposite to each other.

15. The notebook computer of claim 14, wherein the guiding unit has at least one locating portion; the second guiding unit has a third locating portion, disposed at the rear end of the second guiding unit, disposed at the first guiding unit, corresponding to the locating portion; when the locating portion, attaches to the third locating portion, the antenna module is fastened to the holder.

16. The notebook computer of claim 15, wherein the locating portion, disposed at the first guiding unit, is the wide portion of the guiding strips; the third locating portion is the narrow portion of the guiding slots.

17. The notebook computer of claim 16, wherein the first guiding unit respectively has a first locating portion disposed at the front end of the first guiding unit, and a second locating portion disposed at the rear end of the first guiding unit; the second guiding unit has the third locating portion disposed at the rear end of the second guiding unit.

18. The notebook computer of claim 17, wherein the holder further includes a baseplate and a baffleplate; the first side of the baseplate is coupled to the first conductive element, and the baffleplate is disposed at the rear end of the first guiding unit.

19. The notebook computer of claim 18, wherein the front end of the baseplate has an screw aperture; the first side of the baseplate has a plurality of the first fastening elements; the rear end of the baseplate has a second fastening element and a plurality of projections protruding from the holder; the second side of the baseplate has a plurality of bumps; the first fastening element and the second fastening element are used to cord wires; the screwing aperture, the projections and the bumps are used to fasten the holder exterior to the housing.

20. The notebook computer of claim 13, wherein the antenna module comprising:

a body member, forming in a slice-shape, made of soft-plastic material; and a radiating member installed interior to the body member;

wherein the body member and the rear end of the radiating member respectively has a protruded portion; the protruded portion of the radiating member electrically couples to the signal transmission element extending to the downside of the protruded portion of the body member.

21. The notebook computer of claim 20, wherein the antenna module couples to a grounding connection element at the one side of the antenna module; the frond end and rear end of the holder respectively couples to a second conductive element corresponding to the grounding connection element; the protruded portion of the radiating member electrically couples to the grounding connection element extending to the downside of the protruded portion of the body member; wherein the grounding connection element is constantly coupled to the second conductive element whenever the antenna module is open or closed.

22. The notebook computer of claim 21, wherein the holder couples to a metallic grounding member which electrically connects to the second conductive element.

23. The notebook computer of claim 22, wherein the first conductive element and the second conductive element respectively electrically connects to a signal transmission element of a cable and a grounding member, and the cable is used to electrically connect the notebook computer.

24. The notebook computer of claim 23, wherein the housing has a protruded portion disposed at the one side of the housing; the protruded portion forms in an engaging groove for disposing the holder; the protruded portion has an aperture corresponding to the antenna module for exposing the antenna module.

25. The notebook computer of claim 24, wherein the rear end of the two sides of the antenna module respectively has a stopper; the front end and the rear end of the engaging groove respectively has a baffling block corresponding to the stopper for restricting the movement of the antenna module.

* * * * *